US005119772A

United States Patent [19]

Kawamura

[11] Patent Number: 5,119,772

[45] Date of Patent: Jun. 9, 1992

[54] ELECTROMAGNETIC VALVE ACTUATING SYSTEM

[75] Inventor: Hideo Kawamura, Kanagawa, Japan

[73] Assignee: Isuzu Ceramics Research Institute Co., Ltd., Fujisawa, Japan

[21] Appl. No.: 571,522

[22] PCT Filed: Dec. 28, 1989

[86] PCT No.: PCT/JP89/01331

§ 371 Date: Aug. 28, 1990

§ 102(e) Date: Aug. 28, 1990

[87] PCT Pub. No.: WO90/07634

PCT Pub. Date: Jul. 12, 1990

[30] Foreign Application Priority Data

Dec. 28, 1988 [JP] Japan ..... 63-334956

[51] Int. Cl.[5] ..... F01L 9/04

[52] U.S. Cl. ..... 123/90.11; 251/129.01

[58] Field of Search ..... 123/90.11, 90.15; 251/129.01, 129.05, 129.09

[56] References Cited

U.S. PATENT DOCUMENTS

| | | | |
|---|---|---|---|
| 3,743,898 | 7/1973 | Sturman | 317/154 |
| 4,715,332 | 12/1987 | Kreuter | 123/90.11 |
| 4,829,947 | 5/1989 | Lequesne | 123/90.11 |
| 5,009,389 | 4/1991 | Kawamura | 123/90.11 |

FOREIGN PATENT DOCUMENTS

| | | | |
|---|---|---|---|
| 283671 | 9/1988 | European Pat. Off. . | |
| 2616481 | 12/1988 | France | 123/90.11 |
| 183805 | 10/1983 | Japan | 123/90.11 |
| 195004 | 11/1983 | Japan | 123/90.11 |
| 162312 | 9/1984 | Japan | 124/90.11 |
| 6012 | 1/1985 | Japan | 123/90.11 |

*Primary Examiner*—E. Rollins Cross
*Assistant Examiner*—Weilun Lo
*Attorney, Agent, or Firm*—Staas & Halsey

[57] ABSTRACT

An electromagnetic valve actuating system opens and closes intake and exhaust valves of an engine under electromagnetic forces generated by an electromagnet. A reciprocally movable magnetic pole (6) is coupled to an intake/exhaust valve (9) An upper fixed magnetic pole (3*a*) confronts one end of the movable magnetic pole in the direction in which it is reciprocally movable. An intermediate fixed magnetic pole (3*b*) is disposed confronting the one end of the movable magnetic pole and the upper fixed magnetic pole. A lower fixed magnetic pole (3*c*) faces the other end of the movable magnetic pole. The intake/exhaust valve is opened and closed under electromagnetic attracting and repelling forces acting between the one end of the movable magnetic pole and the upper fixed magnetic pole. The timing to open and close the intake/exhaust valve can be varied when the timing to energize the magnetic poles is varied.

12 Claims, 3 Drawing Sheets

ELECTROMAGNETIC VALVE ACTUATING SYSTEM

BACKGROUND OF THE INVENTION

1. Field of the Invention

The present invention relates to an electromagnetic valve actuating system for opening and closing intake and exhaust valves of an engine under electromagnetic forces generated by an electromagnet.

2. Description of the Related Art

Some conventional actuating systems for opening and closing intake and exhaust valves include a single camshaft which has cams to operate the intake and exhaust valves, the camshaft being disposed above or laterally. The camshaft is connected to the crankshaft of the engine by a belt or the like, so that the camshaft can rotate synchronously with the rotation of the engine.

In these conventional systems, the valves are pressed by cam surfaces of the camshaft through a link mechanism such as rocker arms or push rods. The intake and exhaust valves are normally closed by springs, and can be opened when their stem ends are pressed by the cam surfaces.

In alternative conventional systems, an intake camshaft having cams for acting on intake valves and an exhaust camshaft having cams for acting on exhaust valves are disposed above an engine. The intake and exhaust valves are opened when the stem ends of the intake valves are directly pushed by the cam surfaces of the intake camshaft and the stem ends of the exhaust valves are directly pushed by the cam surfaces of the exhaust camshaft.

However, the above conventional actuating systems for opening and closing intake and exhaust valves have several disadvantages. First, the conventional systems include camshafts and link mechanisms which must be added to the engine, and which necessarily renders the engine large in size.

Secondly, since the camshafts and the link mechanisms are driven by the output shaft of the engine, the engine output power is partly consumed due to the frictional resistance produced when the camshafts and the link mechanisms are driven by the engine. As a result, the effective engine output power is reduced.

Finally, the timing with which the intake and exhaust valves are opened and closed cannot be altered during operation of the engine. Instead, the valve opening and closing timing is preset such that the engine operates with high efficiency only when it rotates at a predetermined speed. Therefore, the engine output power and efficiency are lower when the engine rotates at a speed different from the predetermined speed.

To solve the above problems, there have been proposed valve actuating systems for opening and closing intake and exhaust valves under electromagnetic forces from electromagnets, rather than with camshafts, as disclosed in Japanese Laid-Open Patent Publications Nos. 58-183805 and 61-76713.

However, the coils of the electromagnets disclosed in the above publications must be supplied with large electric energy in order to generate electromagnetic forces large enough to actuate the intake and exhaust valves. As a result, the coils radiate a large amount of heat. As the electromagnets are associated with a cooling unit having a considerable cooling capacity, the problem of the large engine size still remains unsolved.

SUMMARY OF THE INVENTION

In view of the aforesaid problems, it is an object of the present invention to provide an electromagnetic valve actuating system for opening and closing intake and exhaust valves of an engine under electromagnetic forces from an electromagnet, rather than with a camshaft, the electromagnet being high in efficiency and output.

According to the present invention, there is provided an electromagnetic valve actuating system for a value which has a movable magnetic pole that is reciprocally movable. A yoke is provided which has an upper fixed magnetic pole confronting one end of the movable magnetic pole, an intermediate fixed magnetic pole confronting the upper fixed magnetic pole and the one end of the movable magnetic pole, and a distal fixed magnetic pole confronting the other of the movable magnetic pole. An upper coil is provided for generating a magnetic flux passing through the upper fixed magnetic pole and a lower coil is provided for generating a magnetic flux passing through the distal fixed magnetic pole. Energization control means are provided for energizing the upper and lower coils to open and close the valve.

The electromagnetic valve actuating system opens the intake/exhaust valve under a repelling force due to a magnetic flux acting between the upper fixed magnetic pole and the intermediate fixed magnetic pole and a magnetic flux acting between the one end of the movable magnetic pole and the intermediate fixed magnetic pole, and closes the valve with a magnetic flux acting between the upper fixed magnetic pole and the one end of the movable magnetic pole. Because the intake/exhaust valve of an engine is opened and closed under electromagnetic forces, rather than with a camshaft, the electromagnetic valve actuating system has an electromagnet which is high in efficiency and output.

DESCRIPTION OF THE PREFERRED EMBODIMENT

An embodiment of the present invention will hereinafter be described in detail with reference to the drawings.

Figure 1:
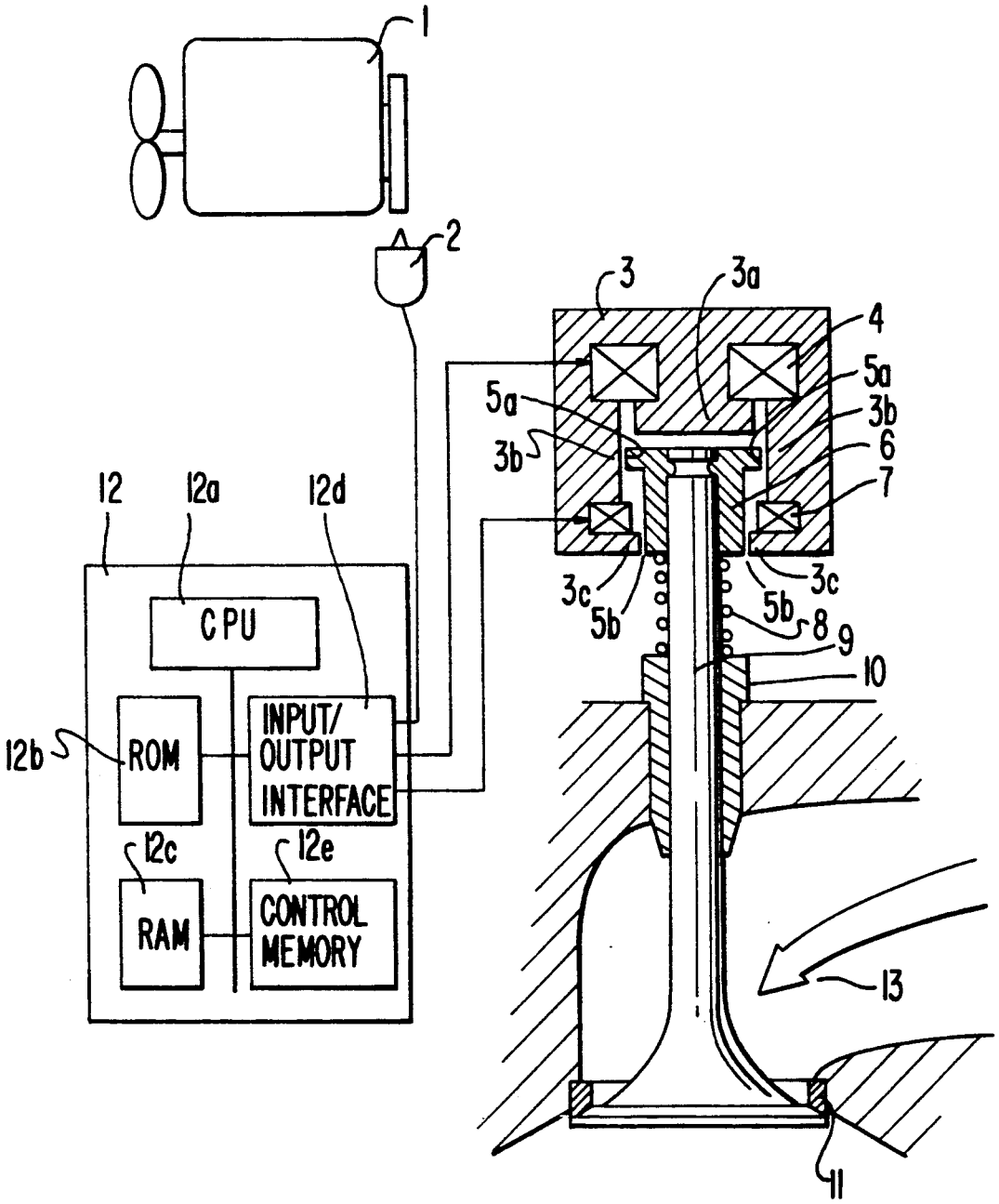
FIG. 1 is a block diagram showing an electromagnetic valve actuating system according to an embodiment of the present invention.

FIG. 1 is a block diagram showing an actuating system according to an embodiment of the present invention. An engine 1 has an output shaft, adjacent to which there is disposed a rotation sensor 2 for detecting the rotational speed and phase of the output shaft and converting the detected speed and phase into a signal. The engine 1 has intake and exhaust ports which are opened and closed by intake and exhaust valves, respectively. Of these intake and exhaust valves, the intake valve will mainly be described below.

An intake valve 9 is made of a nonmagnetic material such as ceramic. The intake valve 9 has a stem axially slidably supported by a valve guide 10. A valve seat 11 is mounted in the intake port of an intake passage 13.

The intake port is closed when the head of the intake valve 9 is closely held against the valve seat 11. The end of the stem of the intake valve 9 is coupled to a movable magnetic pole 6.

Between the movable magnetic pole 6 and the valve guide 10, there is disposed a spring 8 for preventing the intake valve 9 from dropping into the engine cylinder when the engine is not in operation.

The movable magnetic pole 6 is surrounded by an electromagnet 3 disposed therearound. The electromagnet 3 has an upper fixed magnetic pole 3*a* positioned therein and facing the end face of the movable magnetic pole 6, and an intermediate fixed magnetic pole 3*b* extending around and facing the outer circumferential surface of the movable magnetic pole 6. The electromagnet 3 also has a distal (lower) fixed magnetic pole 3*c* disposed in an opening thereof and confronting the stem side of the movable magnetic pole 6.

An upper coil 4 is disposed in the electromagnet 3 between the upper fixed magnetic pole 3*a* and the intermediate fixed magnetic pole 3*b*, and a lower coil 7 is disposed in the electromagnet 3 between the intermediate fixed magnetic pole 3*b* and the distal fixed magnetic pole 3*c*.

The intermediate fixed magnetic pole 3*b* and the movable magnetic pole 6 are held out of contact with each other, by only a small gap 5*a* defined therebetween. The distal fixed magnetic pole 3*c* and the movable magnetic pole 6 are also held out of contact with each other by only a small gap 5*b* defined therebetween.

The rotation sensor 2, the upper coil 4, and the lower coil 7 are electrically connected to an input/output interface 12*d* in a control unit 12. The control unit 12 includes, in addition to the input/output interface 12*d* which transmits output signals and receives an input signal, a ROM 12*b* for storing a program and data, a CPU 12*a* for effecting arithmetic operations under the control of the program stored in the ROM 12*b*, a RAM 12*c* for temporarily storing the input signals and the results of arithmetic operations, and a control memory 12*e* for controlling the flow of signals in the control unit 12.

Operation of the electromagnetic valve actuating system according to the present invention will be described below.

Figure 2A:
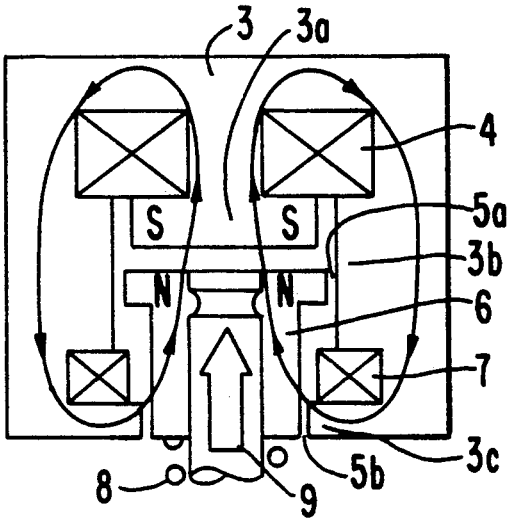
FIGS. 2(*a*) through 2(*c*) are diagrams showing the flow of magnetic lines of force within an electromagnet.
Figure 2B:
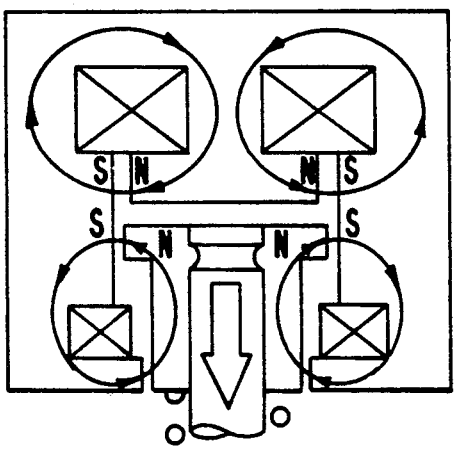
Figure 2C:
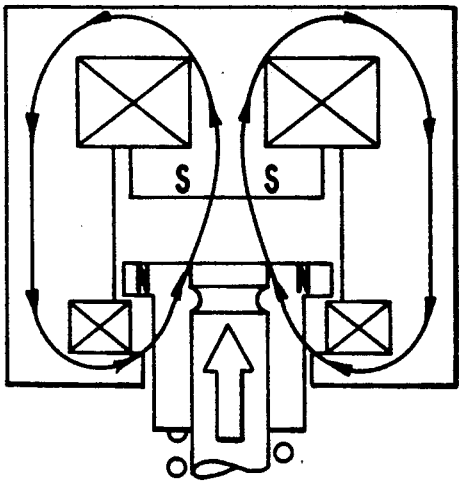

FIGS. 2(*a*) through 2(*c*) show the flow of magnetic lines of force in the electromagnet 3. FIG. 2(*a*) shows the flow of magnetic lines of force when the valve is to be closed, FIG. 2(*b*) shows the flow of magnetic lines of force when the valve starts being opened from the close condition, and FIG. 2(*c*) shows the flow of magnetic lines of force when the valve starts to move in a closing direction after its movement in the opening direction has been decelerated.

In FIG. 2(*a*), the upper coil 4 and the lower coil 7 are energized with supplied DC electric energy in order to generatemagnetic lines of force in the same direction.

The magnetic lines of force generated by the upper and lower coils 4, 7 pass through a magnetic path which extends from the upper fixed magnetic pole 3*a* through the inside of the electromagnet 3 to the distal fixed magnetic pole 3*c*, and then from the distal fixed magnetic pole 3*c* through the gap 5*b* to the movable magnetic pole 6 and then back to the upper fixed magnetic pole 3*a*.

When the magnetic lines of force flow as described above, an S (South) pole is created on the upper fixed magnetic pole 3*a*, and an N (North) pole is created on the movable magnetic pole 6 at its surface confronting the upper fixed magnetic pole 3*a*. Therefore, the upper fixed magnetic pole 3*a* and the movable magnetic pole 6 are attracted to each other.

Immediately before the upper fixed magnetic pole 3*a* and the movable magnetic pole 6 contact each other, the head of the intake valve 9 is closely held against the valve seat 11, thereby closing the intake port.

As shown in FIG. 2(*b*), when the rotational phase of the engine 1 as detected by the rotation sensor 2 reaches the timing to open the intake valve 9, the direction in which the electric current is supplied to the upper coil 4 is reversed. The direction of magnetic lines of force which are generated by the upper coil 4 is also reversed. The magnetic lines of force generated by the upper coil 4 flow through a magnetic path which extends from the upper fixed magnetic pole 3*a* to the intermediate fixed magnetic pole 3*b*, and then back to the upper fixed magnetic pole 3*a*.

The magnetic lines of force generated by the lower coil 7 flow through a magnetic path that extends from the distal fixed magnetic pole 3*c* through the gap 5*b* to the movable magnetic pole 6, and then through the gap 5*a* and the intermediate fixed magnetic pole 3*b* back to the distal fixed magnetic pole 3*c*.

With the magnetic paths thus produced, N poles are created on both the movable magnetic pole 6 at its surface facing the upper fixed magnetic pole 3*a* and the upper fixed magnetic pole 3*a*. Thus, the upper fixed magnetic pole 3*a* and the movable magnetic pole 6 are repelled from each other. Accordingly, the intake valve 9 is repelled downwardly, starting to move in the opening direction.

As illustrated in FIG. 2(*c*), the direction in which the electric current is supplied to the upper coil 4 is reversed upon elapse of a first preset time after the intake valve 9 has started moving in the opening direction. As with the condition shown in FIG. 2(*a*), the intake valve 9 is subjected to an attractive force in the upward direction, i.e., in the closing direction. The attractive force serves to decelerate the intake valve 9 which is moving in the opening direction, and finally stop the intake valve 9. The position in which the intake valve 9 is stopped corresponds to a position in which it has traversed the maximum stroke.

After the intake valve 9 is stopped, the upper and lower coils 4, 7 are continuously energized to start moving the intake valve 9 in the upward direction, i.e., in the opening direction.

Upon elapse of a second preset time which is longer than the first preset time, the electric current supplied to the upper coil 4 is reversed, applying a downward force to the intake valve 9. This is to decelerate the intake valve 9 as it moves in the closing direction, thereby lessening shocks imposed when the head of the intake valve 9 is seated on the valve seat 11.

Upon elapse of a third preset time which is longer than the second preset time, the electric current supplied to the upper coil 4 is reversed again, so that the magnetic path shown in FIG. 2(*a*) is formed, imposing an upward force on the intake valve 9. The intake valve 9 now closes the intake port, and holds the intake port closed until the next opening timing.

The first, second, and third preset times are determined as follows: A table of preset times and engine rotational speeds is stored in advance in the ROM 12*b*, and a preset time corresponding to a certain engine rotational speed is determined from the table based on the engine rotational speed.

The opening and closing condition of the valve will be described with reference to FIG. 3.

Figure 3:
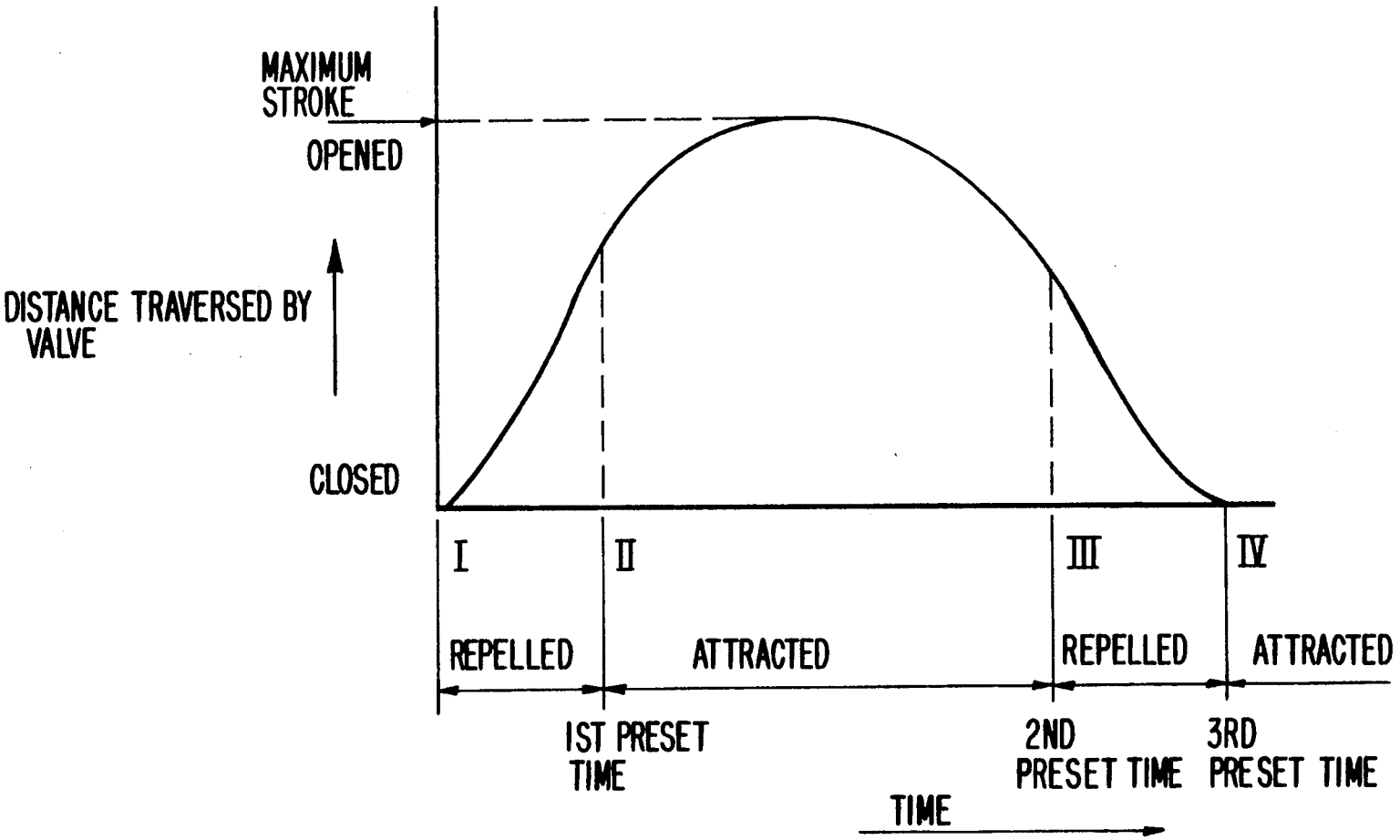
FIG. 3 is a graph showing the relationship between time and the distance which the valve moves and time.

FIG. 3 shows a so-called cam profile curve. The horizontal axis of the graph indicates the time from the opening timing of the intake valve 9, and the vertical axis indicates the distance by which the intake valve 9 moves. The curve in FIG. 3 shows the change, over time, in the distance by which the intake valve moves.

At a time I which is the valve opening timing, the electric current supplied to the upper coil 4 is reversed to switch the flow of magnetic lines of force from the condition shown in FIG. 2(*a*) to the condition shown in FIG. 2(*b*). The intake valve 9 is now subjected to a repelling force in the opening direction, and starts moving in the opening direction.

At a time II when the first preset time elapses, the electric current supplied to the upper coil 4 is reversed to switch the flow of magnetic lines of force from the condition shown in FIG. 2(*b*) to the condition shown in FIG. 2(*c*). An attractive force in the closing direction now acts on the intake valve 9, decelerating the intake valve 9 as it moves in the opening direction. After the intake valve 9 has reached the maximum stroke position, the intake valve 9 reverses its movement for the closing direction.

At a time III when the second preset time elapses, an attractive force in the opening direction is applied again to the intake valve 9, decelerating the intake valve 9 as it moves in the closing direction.

At a time IV when the third preset time elapses, the magnetic lines of force are brought into the condition shown in FIG. 2(*a*). The intake valve 9 remains closed until the next opening timing.

When the operation of the engine 1 is finished, the upper and lower coils 4, 7 are de-energized, and any electromagnetic forces for holding the intake valve 9 closed are eliminated. Therefore, the intake valve 9 is maintained in the closed position by the spring 8. The holding force of the spring 8 is sufficiently small with respect to the repelling force generated by the upper and lower coils 4, 7 to open the intake valve 9.

The ROM 12 may store, in addition to the table of preset times and engine rotational speeds, a map of engine rotational speeds and valve opening timing values. By varying the valve opening timing depending on the engine rotational speed using the map, the engine output and efficiency can be increased in a full range of engine rotational speeds.

Furthermore, an engine cylinder control process for increasing or reducing the number of engine cylinders that are in operation can be carried out by actuating or disabling the intake and exhaust valves associated with the engine cylinders depending on the rotational speed of the engine 1.

The magnetically interrupted portions of the magnetic path in the electromagnet 3, i.e., the gap 5*a* between the movable magnetic pole 6 and the intermediate fixed magnetic pole 3*b* and the gap 5*a* between the movable magnetic pole 6 and the distal fixed magnetic pole 3*c*, are small irrespective of whether the valve is opened or closed, and hence any leakage of magnetic lines of force from the magnetic path is small. Accordingly, the electromagnetic forces generated by the electromagnet 3 is strong. As a result, the efficiency with which the electromagnetic forces are generated is increased, and the electric energy supplied to the electromagnet is reduced, resulting in a reduction in the amount of heat generated by the electromagnet 3.

While the intake valve has been described above, the actuating system of the present invention is also applicable to the exhaust valve, which is omitted from illustration.

Although a certain preferred embodiment has been shown and described, it should be understood that the present invention should not be limited to the illustrated embodiment but many changes and modifications may be made therein without departing from the scope of the appended claims.

As described above, the electromagnetic valve actuating system according to the present invention is useful as a system for actuating intake and exhaust valves of an engine, and suitable for use with an engine which is required to vary the timing to open and close the intake and exhaust valves freely.

I claim:

1. An electromagnetic valve actuating system for opening and closing a valve such as an intake and exhaust valve of an engine, comprising:

a movable magnetic pole coupled to the valve, said movable magnetic pole having a first end and a second end and being mounted for reciprocating movement with the valve;

a yoke having an upper fixed magnetic pole confronting the first end of said movable magnetic pole, an intermediate fixed magnetic pole confronting said upper fixed magnetic pole and the first end of said movable magnetic pole, and a distal fixed magnetic pole confronting the second end of said movable magnetic pole;

an upper coil for generating a magnetic flux passing through the upper fixed magnetic pole;

a lower coil generating a magnetic flux passing through said distal fixed magnetic pole; and energization control means for energizing said upper and lower coils to open and close said valve.

2. An electromagnetic valve cutting system according to claim 1, wherein said valve (9) is made of ceramic.

3. An electromagnetic valve actuating system according to claim 1, wherein said energization control means applies a repelling force acting between said upper fixed magnetic pole and the first end of said movable magnetic pole before said valve is seated, thereby lessening shocks produced when the valve is seated.

4. An electromagnetic valve actuating system according to claim 1, wherein the timing established by said energization control means to open and close the valve is variable as the rotational speed of the engine varies.

5. A valve control system in an engine, comprising:

an electromagnet having coils and having upper, intermediate and lower magnetic poles;

a valve, having a movable magnetic pole closely confronting the upper, intermediate and lower magnetic poles in said electromagnet; and control means for controlling movement of said valve without mechanical spring force control by independently energizing and deenergizing the coils of said electromagnet at timings corresponding to a speed of the engine.

6. A valve control system in an engine, comprising:

an electromagnet having coils and having upper, intermediate and lower magnetic poles;

a valve, having a movable magnetic pole closely confronting the upper, intermediate and lower magnetic poles in said electromagnet;

control means for controlling movement of said valve by energizing and deenergizing the coils of said electromagnet at timings corresponding to a speed of the engine;

wherein the coils in the electromagnet include an upper coil and a lower coil, wherein said control means energizes the upper coil and lower coil to create a magnetic line of force from the upper magnetic pole through the electromagnet to the lower magnetic pole and through the movable magnetic pole back to the upper magnetic pole to hold the valve closed, wherein said control means energizes the upper coil to create a magnetic line of force from the upper magnetic pole to the intermediate magnetic pole and back to the upper magnetic pole to open the valve, and said control means energizes the lower coil to create a magnetic line of force from the lower magnetic pole to the movable magnetic pole to the intermediate magnetic pole and back to the lower magnetic pole, to open the valve.

7. A valve control system according to claim 6, further comprising speed detection means for detecting the speed of the engine, said control means comprising a control unit including an input/output interface connected to said electromagnets and said speed detection means, a storage storing a table of the timings corresponding to different speeds of the engine, and a processor calculating the timings based on the speed detected by said detection means.

8. A method of controlling a valve with a movable magnetic pole in an engine, comprising the steps of:

(a) detecting a speed of the engine;

(b) reading the speed of the engine into a computer; and (c) independently energizing and deenergizing an electromagnet having an upper, intermediate and lower pole to control movement of the valve with magnetic lines of force through the movable pole and the upper, intermediate and lower magnetic poles, and without mechanical spring force control.

9. A method according to claim 8, wherein said energizing and deenergizing of the electromagnets in step (c) is performed at the timings read by the computer from a preset speed/timing table based on the speed of the engine.

10. A method of controlling a valve with a movable magnetic pole in an engine, comprising the steps of:

(a) detecting a speed of the engine;

(b) reading the speed of the engine into a computer; and (c) energizing and deenergizing an electromagnet having an upper, intermediate and lower pole to control movement of the valve with magnetic lines of force through the movable pole and the upper, intermediate and lower magnetic poles wherein step (c) further comprises the steps of (c1) holding the valve closed by energizing an upper coil of the electromagnet to create a magnetic line of force from the upper magnetic pole through the electromagnet to the lower magnetic pole and then through the movable magnetic pole back to the upper magnetic pole, (c2) opening the valve by reversing current supplied to the upper coil to create a magnetic line force from the upper magnetic pole to the intermediate magnetic pole and back to the upper magnetic pole, and energizing a lower coil in the electromagnet to create a magnetic line of force from the lower magnetic pole through the movable magnetic pole to the intermediate magnetic pole and back to the lower magnetic pole, and (c3) closing the valve by repeating step (c1).

11. A method according to claim 10, further comprising the step of (c4) decelerating the valve before it is closed by reversing current supplied to the upper coil and (c5) closing the valve by again reversing the current supplied to the upper coil.

12. A method according to claim 11, wherein steps (c1) through (c5) are repeated with each full piston stroke of the engine.

* * * * *